US006012946A

United States Patent [19]

Fukase

[11] Patent Number: 6,012,946

[45] Date of Patent: Jan. 11, 2000

[54] CONNECTOR FITTING-DETECTION MECHANISM

[75] Inventor: Yoshihiro Fukase, Shizuoka, Japan

[73] Assignee: Yazaki Corporation, Tokyo, Japan

[21] Appl. No.: 09/205,224

[22] Filed: Dec. 4, 1998

[30] Foreign Application Priority Data

Dec. 4, 1997 [JP] Japan ..... 9-334380

[51] Int. Cl.[7] ..... H01R 3/00

[52] U.S. Cl. ..... 439/489; 439/352

[58] Field of Search ..... 439/352, 353, 439/354, 357, 488, 489

[56] References Cited

U.S. PATENT DOCUMENTS 5,775,930 7/1998 Model et al. ..... 439/352
5,839,915 11/1998 Ford et al. ..... 439/489

FOREIGN PATENT DOCUMENTS 8-31517 2/1996 Japan ..... H01R 13/64

*Primary Examiner*—Khiem Nguyen

*Attorney, Agent, or Firm*—Sughrue, Mion, Zinn Macpeak & Seas, PLLC

[57] ABSTRACT

A connector fitting-detection mechanism which is rigid and simple in structure. In the connector fitting-detection mechanism (1), a fitting detection member (6) having flexible detection arms (7), which are provided with engagement projections (8) at the tip portions thereof, is supported at the rear portion of a female connector (2) so that the fitting detection member (6) is slidable forward and backward. A provisional engagement hole (10) and a primary engagement hole (11) engaging with the engagement projection (8) are provided along the fitting direction at each of the opposite side walls of the female connector (2). A disengagement projection (12) is provided at the front portion of each of the opposite side walls of a male connector (4). At the time of the complete fitting between the female and male connectors (2), (4), each of the projections (12) abuts against the provisionally engaged engagement projection (8) thereby to release the provisional engagement state thereof, so that the engagement projections (8) pass over the provisional engagement holes (10) and primarily engage with the primary engagement holes (11).

3 Claims, 9 Drawing Sheets

CONNECTOR FITTING-DETECTION MECHANISM

BACKGROUND OF THE INVENTION

1. Field of the Invention

The present invention relates to a connector fitting-detection mechanism in which a complete fitting state of female and male connectors is detected through a slide operation, and which has a function of locking the complete fitting state of the connectors.

The present application is based on Japanese Patent Application No. Hei. 9-334380, which is incorporated herein by reference.

2. Description of the Related Art

Conventionally, there have been known various kinds of connector fitting-detection mechanism. For example, there is known a connector fitting detection mechanism disclosed in Unexamined Japanese Patent Publication No. Hei. 8-31517. FIGS. 6 to 10 shows a connector fitting-detection mechanism 51 in which a fitting detection member 56 includes a flexible detection arm 57 having an engagement projection 58 at a tip potion thereof and extending in a fitting direction of a female connector 52 and a male connector 54. The flexible detection arm 57 is attached to a rear portion of a housing 55 of the male connector 54, and is slidable forward and backward along the housing 55.

A provisional engagement portion 60 and a primary engagement portion 61 for engaging with the engagement projection 58 are located at forward and backward portions of an engagement stop plate 59 along the fitting direction of the connectors. The engagement stop plate 59 is provided on the housing 55. A disengagement projection 62 is provided at a front portion of the housing 53 of the female connector 52. When the female connector 52 and the male connector 54 are completely fitted to each other, the disengagement projection 62 abuts against the provisionally engaged engagement projection 58 to release the provisional engagement with the provisional engagement portion 60, so that the engagement projection 58 moves beyond the engagement stop plate 59 and primarily engages with the primary engagement portion 61.

More specifically, the engagement stop plate 59 lies on the upper surfaces of two flexible cantilevered plates 63 which have a cantilevered shape and are fixed on the upper surface of the housing 55 to be extended backward. A pushing plate 64 having a wide width lies on the upper surfaces of the rear portions of the flexible cantilevered plates 63. Portions of the pushing plate 64, which protrude from the side portions of the two flexible cantilevered plates 63, are defined as guide portions 64*a*.

Guide pieces 65*a* are arranged to be hung from the both ends of an operation plate portion 65 which extends in the longitudinal direction on the upper surface of the fitting detection member 56, and respectively have protrusions at the tip portions thereof. The guide pieces 65*a* are slidably guided forward and backward by the pushing plates 64. A tapered portion 58*a* has a substantially rectangular shape in cross section, and is provided at the front end of the engagement projection 58. A locking mechanism (not shown) is provided in the female and male connectors 52 and 54 for the complete fitting of the connectors. The above connector fitting-detection mechanism 51 is assembled as follows. First, a female terminal connected to a covered wire W at the rear portion thereof is inserted into the housing 55 of the male connector 54 from the rear side of the housing 55. Afterwards, the fitting detection member 56 is attached to the guide portion 64*a* from the rear side of the pushing plate 64. At this time, as shown in FIG. 7, the engagement projection 58 abuts against the rear end of the engagement stop plate 59 and is positioned at the provisional engagement portion 60, and further, the operation plate portion 65 is positioned at the upper surface of the pushing plate 64. Thus, the assembly of the male connector 54 is completed.

Similarly, a male terminal connected to a covered wire W at the rear portion thereof is inserted into the housing 53 of the female connector 52 from the rear side of the housing 53. Thus, the assembly of the female connector 52 is completed.

When the male connector 54 is assembled, the fitting detection member 56 does not move even if it is pushed forward, because the engagement projection 58 is fitted into the provisional engagement portion 60. Accordingly, if the fitting detection member 56 is positioned at the rear end portion of the male connector 54 when the male connector 54 and the female connector 52 are fitted to each other, it is understood from the outward appearance such that the fitting between the male connector 54 and the female connector 52 is still in a midway state.

When the male connector 54 is fitted into the female connector 52, the disengagement projection 62 abuts against the front end surface of the engagement stop plate 59 of the housing 55, and the fitting operation is temporarily stopped. In this state, as shown in FIG. 8, when the operation plate portion 65 of the fitting detection member 56 is pushed downward, the pushing plate 64 is also pushed downward. Accordingly, the flexible cantilevered plates 63 are bent such that the engagement stop plate 59 is displaced downward, and the fitting operation between the female and male connectors 52, 54 is restarted.

Afterwards, as shown in FIG. 9, the disengagement projection 62 moves beyond the engagement stop plate 59 and fits into the provisional engagement portion 60, so that the engagement projection 58 of the fitting detection member 56 is displaced downward and disengages from the provisional engagement portion 60, whereby the fitting operation between the female and male connectors is completed. Accordingly, as shown in FIG. 10, when the fitting detection member 56 is pushed forward, the engagement projection 58 moves along the lower surface of the engagement stop plate 59 and fits into the primary engagement portion 61 and engages with the front end surface of the engagement stop plate 59. As a result, since the fitting detection member 56 moves to the intermediate position of the housing 55, it is understood from the outward appearance such that the fitting between the male connector 54 and the female connector 52 is completed.

However, the midway state and the completion state of the fitting between the female and male connectors 52, 54 are detected in such a manner that the position of the fitting detection member 56 is defined or restricted by using the flexible cantilevered plates 63 of the male connector 54 and the disengagement projection 62 of the female connector 52. Therefore, there is a problem in that productivity of the connector fitting-detection mechanism is degraded since the configuration of the flexible cantilevered plates 63 is complicated.

Further, the fitting detection member 56 is supported by the flexible cantilevered plates 63 through the pushing plate 64, and the flexible detection arm 57 is small in size and the number thereof is single. Therefore, there may not be a desired sufficient rigidity even if the engagement projection 58 engages with the primary engagement portion 61.

Accordingly, since another locking mechanism (not-shown) is required in order to lock the completely fitted female and male connectors 52, 54, there is a possibility in that the cost of the connector fitting detection mechanism is increased.

SUMMARY OF THE INVENTION

The present invention has been made in view of the aforesaid problem and an object of the present invention is to provide a connector fitting-detection mechanism in which the structure and a supporting mechanism thereof have rigidity and are simple, and has a locking function as well as the fitting detection function for female and male connectors.

In order to achieve the above object, according to the first aspect of the present invention, there is provided a connector fitting-detection mechanism, comprising: a pair of provisional engagement portions and a pair of primary engagement portions arranged at one of female and male connectors; a pair of disengagement projections disposed on a front portion of the other one of the female and male connectors; and a fitting detection member attached onto a rear portion of the one of the female and male connectors, the fitting detection member which includes: a shell body supported by and slidable on the rear portion of the one of the female and male connectors, and a pair of flexible detection arms respectively extending from opposite side walls of the shell body in a connector fitting direction of the one of the female and male connectors, the flexible detection arms having engagement projections, wherein, when the fitting detection member is provisionally engaged with the one of the female and male connectors, the engagement projections are engaged with the provisional engagement portions, respectively; and wherein when the female and male connectors are completely fitted to each other, the engagement projections are primarily engaged with the primary engagement portion, respectively. Accordingly, the structures of the fitting detection member and the one of the connectors can be simplified and the rigidity thereof can be enhanced. Further, since a pair of the flexible detection arms are provided, the fitting detection member can detect the fitting state of the female and male connectors and have the fitting locking function. Thus, since it is not required to provide another locking mechanism in addition to the fact that the fitting detection mechanism is simple in the arrangement and can be easily manufactured, the productivity of the connector fitting detection mechanism can be improved and the manufacturing cost thereof can be reduced.

Further, according to the second aspect of the present invention, in the connector fitting-detection mechanism, when fitting of the female and male connectors is started, the disengagement projections respectively abut against the engagement projections, and afterwards, the fitting detection member is pushed to move the engagement projections beyond the provisional engagement portions to release the provisional engagement.

Further, according to the third aspect of the present invention, the connector fitting-detection mechanism may further comprises: a locking hole formed in a surface of the one of the female and male connectors which is not interfered by the provisional engagement portions and the primary engagement portions; and a locking projection formed on the other one of the female and male connectors in correspondence with the locking hole. The locking hole is provided at the surface of the one of the female and male connectors which is not interfered by the provisional engagement portions and the primary engagement portions, and the locking projection is provided at the other of the female and male connectors in correspondence with the locking hole. Accordingly, since another locking mechanism is thus added, the reliability of the locking function of the connector fitting can be further improved.

DETAILED DESCRIPTION OF THE PREFERRED EMBODIMENT

Figure 1:
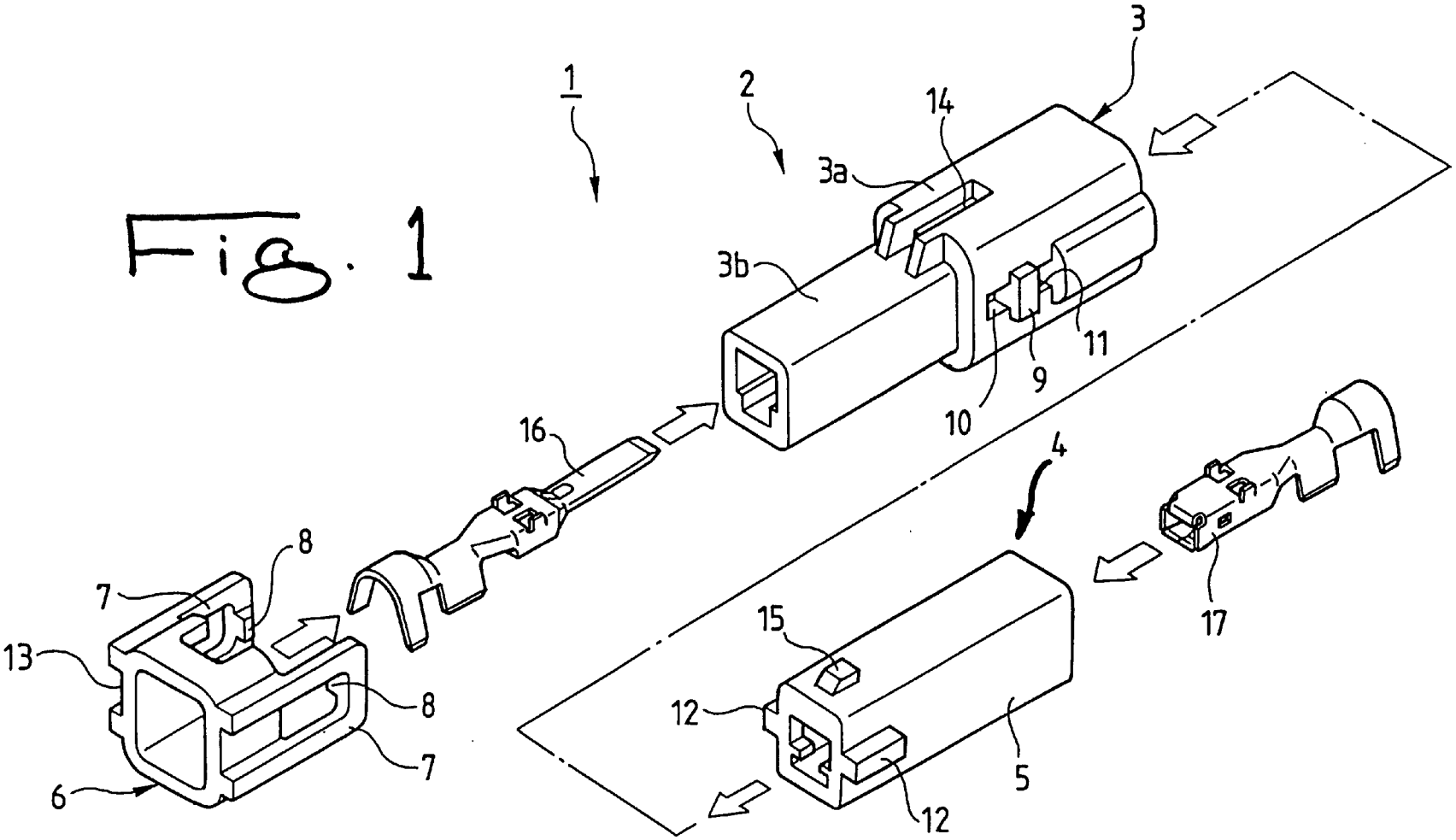
FIG. 1 is an exploded perspective view showing a connector fitting-detection mechanism according to a preferred embodiment of the present invention.

A preferred embodiment of a connector fitting-detection mechanism according to the present invention will be described with reference to FIGS. 1 to 5.

In a connector fitting-detection mechanism 1, a fitting detection member 6 includes flexible detection arms 7 having engagement projections 8 at the tip potions thereof. The fitting detection member 6 is attached onto a rear portion of a housing 3 of a female connector 2 such that the fitting detection member 6 is slidable forward and backward along the housing. The flexible detection arms 7 extend in a fitting direction of the female connector 2. Engagement stop plates 9 are provided at both sides of the housing 3 of the female connector 2. Provisional engagement holes 10 for engaging with the engagement projections 8 are respectively located at backward portions of the engagement stop plates 9. Also, primary engagement holes 11 for engaging with the engagement projections 8 are respectively located at forward portions of the engagement stop plates 9.

Disengagement projections 12 are provided on a front portion of a housing 5 of a male connector 4 at the portions corresponding to the provisional engagement holes 10. When the female connector 2 and the male connector 4 are completely fitted to each other, the projections 12 respectively abut against the provisionally engaged engagement projections 8 so as to release the provisional engagement state with the provisional engagement holes 10, so that the engagement projections 8 are displaced from the provisional engagement holes 10 and primarily engage with the primary engagement holes 11.

More specifically, the engagement stop plates 9, the provisional engagement holes 10 and the primary engagement holes 11 are respectively disposed at the opposite both sides of a front housing 3a of the female connector 2. The fitting detection member 6 includes a shell body 13 having a hollow cylindrical shape. The shell body 13 is slidably supported by a rear housing 3*b* of the female connector 2. The portion of the shell body 13 where the rear end surface of the front housing 3*a* abuts against serves as the forefront end portion of the shell body 13.

A locking hole 14 is formed in the upper surface of the housing 3 of the female connector 2 which does not interfere the provisional engagement holes 10 and the primary engagement holes 11 respectively provided at the both side walls of the housing 3. A locking projection 15 is disposed on the upper surface of the housing 5 of the male connector 4 at the portion corresponding to the locking hole 14. Housing lances (not shown) are provided within the housings 3, 5 of the female and male connectors 2, 4 so that female and male terminals 16, 17 engages with the housing lances when the female and male terminals are inserted within the housings from the rear end portions thereof, respectively.

Figure 2:
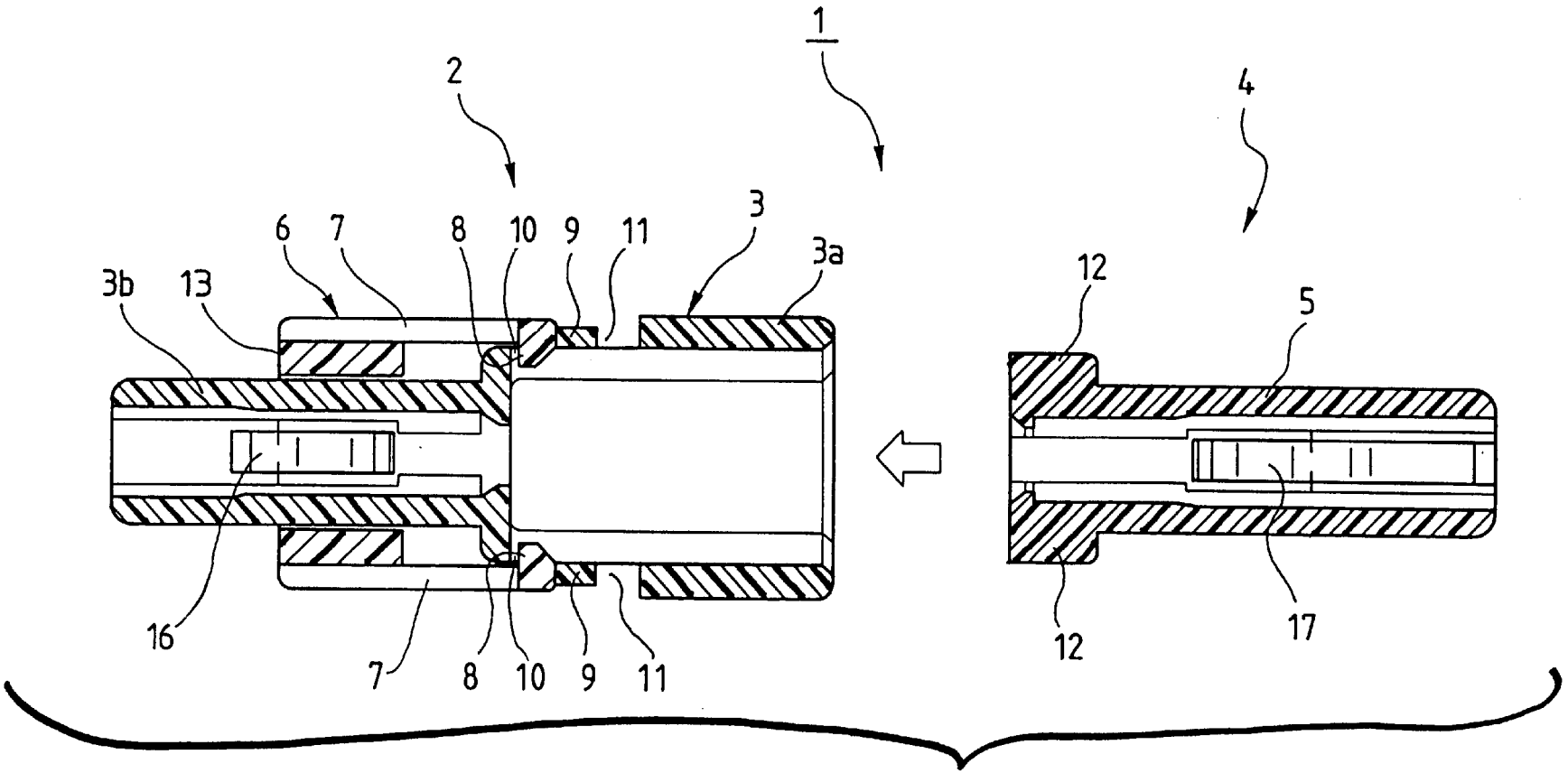
FIG. 2 is a longitudinal sectional view showing a state in which the female and male connectors of FIG. 1 are not fitted.

According to the connector fitting-detection mechanism 1 as arranged in the above manner, as shown in FIG. 2, when the fitting detection member 6 is fitted onto the rear housing 3*b* serving as a guide from the rear portion of the housing 3 of the female connector 2, the engagement projections 8 abut against the rear end surface of the front housing 3*a* and move forward while flexing the flexible detection arms 7 outwardly, and then the engagement projections 8 provisionally engage with the provisional engagement holes 10. At this time, since the front end surfaces of the flexible detection arms 7 abut against the engagement stop plates 9, the flexible detection arms do not move forward even if they are pushed. Further, the front end surface of the shell body 13 does not abut against the rear end surface of the front housing 3*a*. Accordingly, the non-fitting state and the midway-fitting state of the female and male connectors 2, 4 can be easily detected on the basis of the position of the fitting detection member 6 relative to the housing 3.

Further, the male terminal 16 to which a covered wire (not shown) is connected is inserted into the housing 3 from the rear side thereof to engage with the housing lance (not shown) to thereby complete the assembly of the female connector 2. Also, the female terminal 17 to which a covered wire (not shown) is connected is inserted into the housing 5 from the rear side thereof to engage with the housing lance (not shown) to thereby complete the assembly of the male connector 4.

Figure 3:
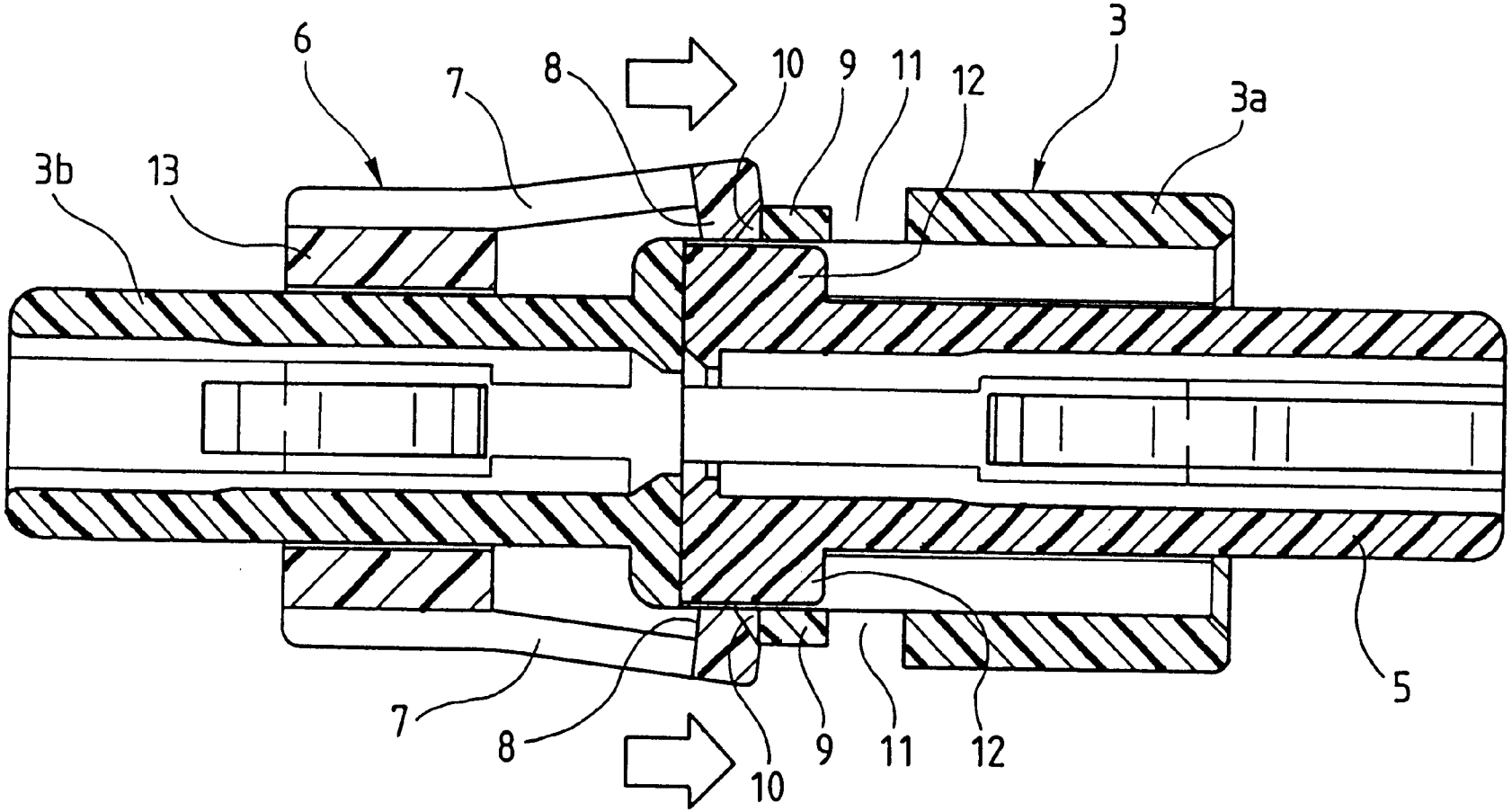
FIG. 3 is an operation explanatory diagram showing a state in which the fitting between the female and male connectors of FIG. 2 is started.
Figure 4:
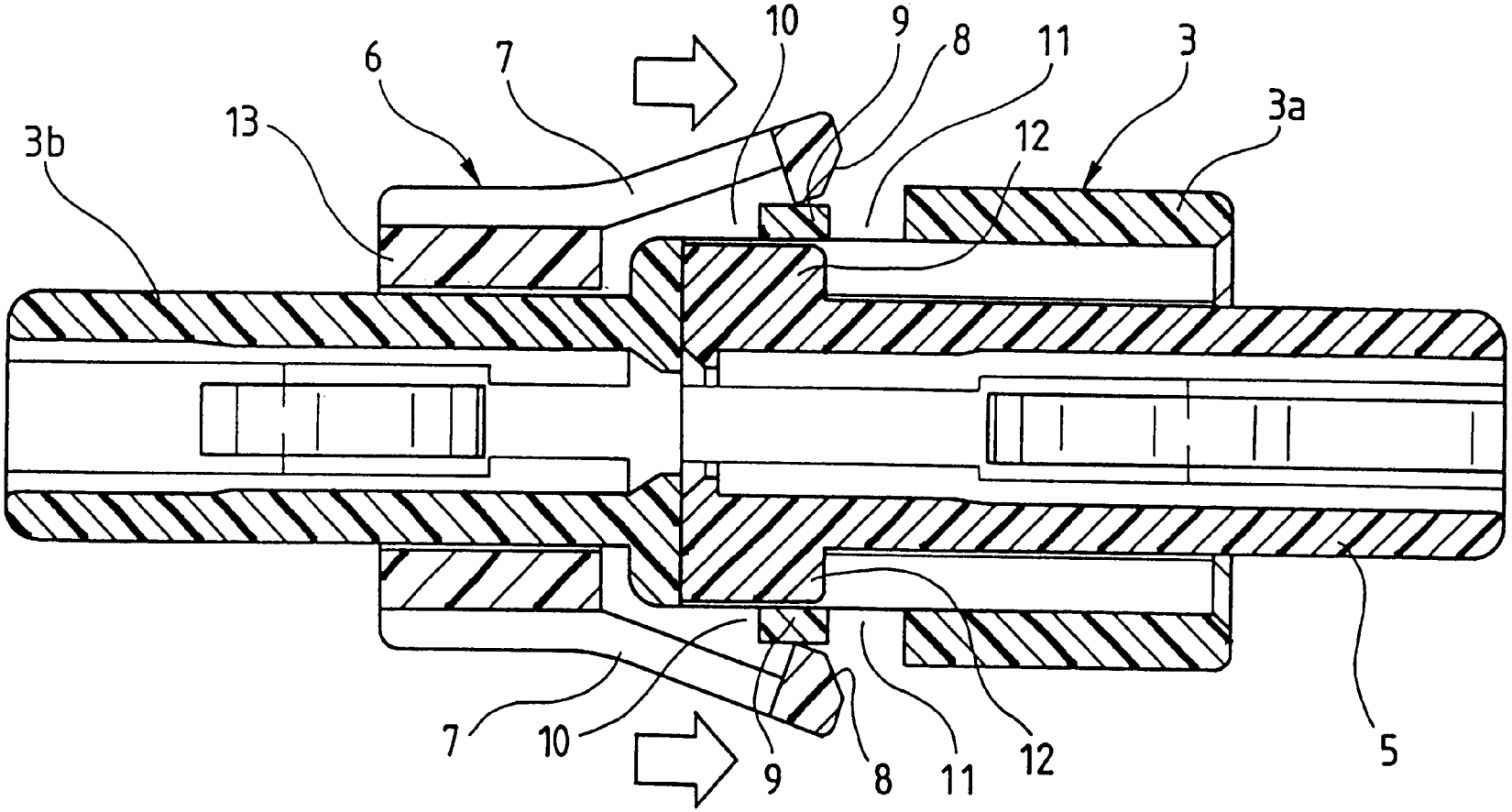
FIG. 4 is an operation explanatory diagram showing a midway state of the fitting between the female and male connectors of FIG. 2.
Figure 5:
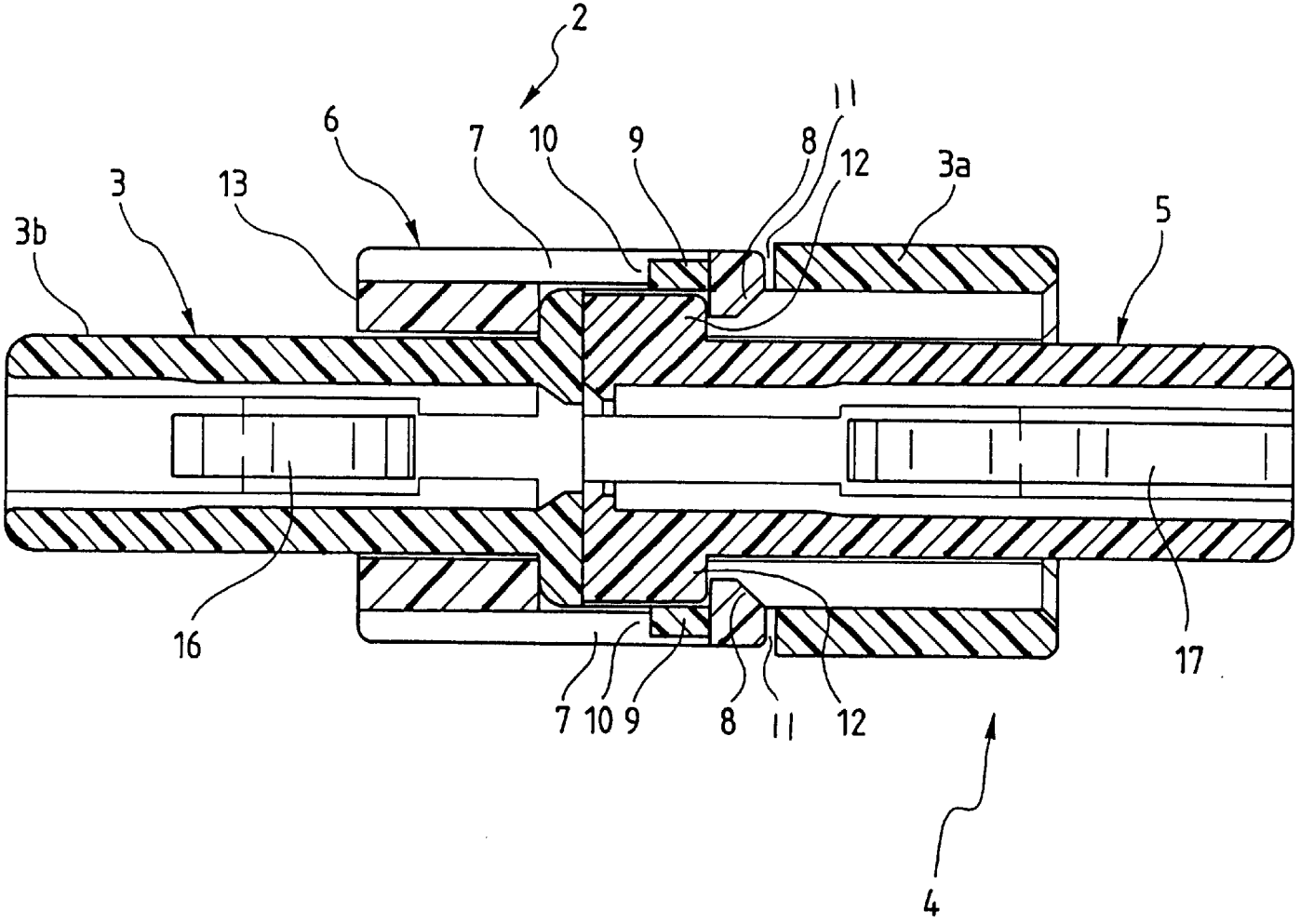
FIG. 5 is a longitudinal sectional view showing a state of the completion of the fitting between the female and male connectors of FIG. 2.
Figure 6:
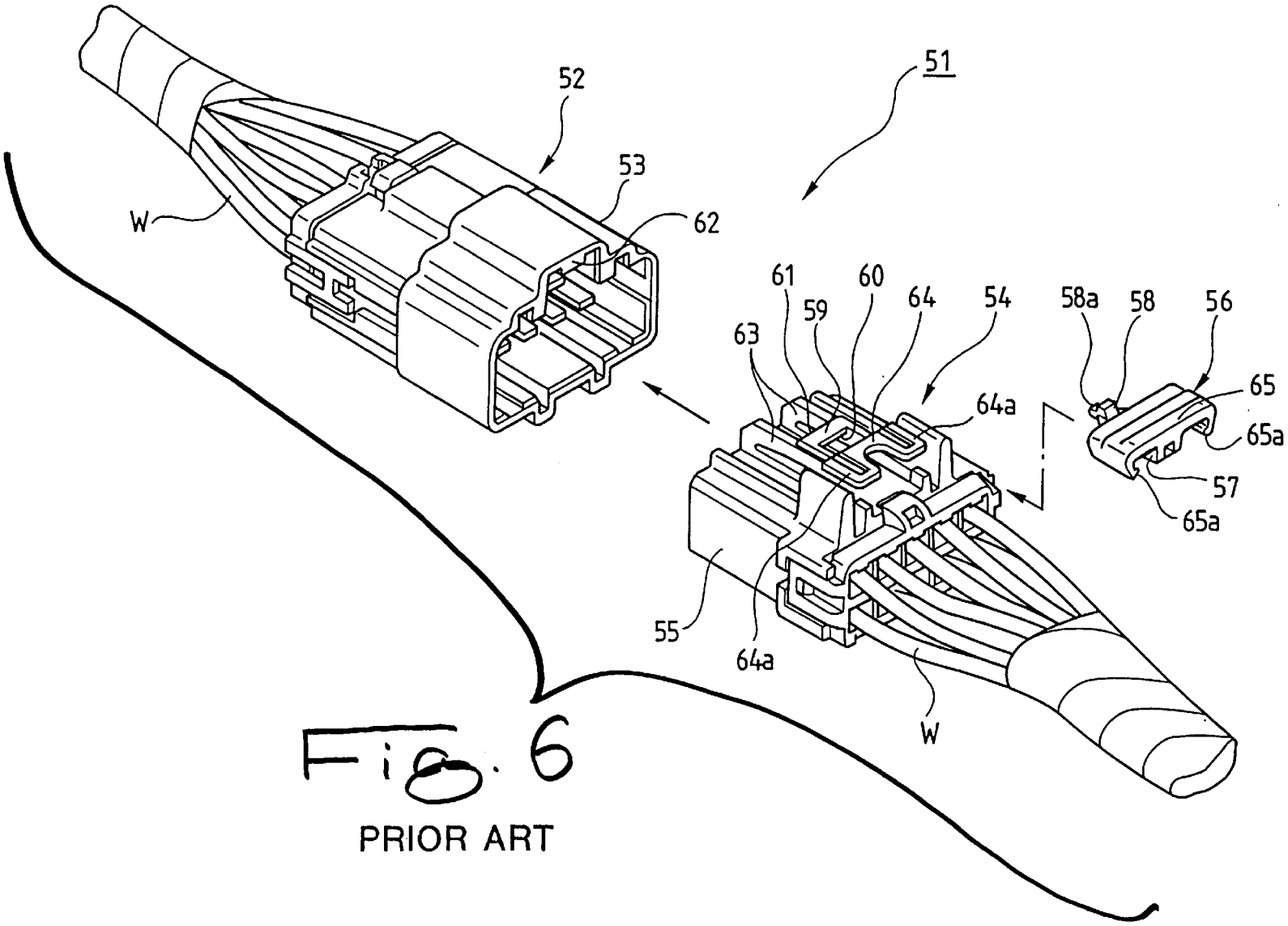
Fig. 6 PRIOR ART
FIG. 6 is an exploded perspective view showing an example of a connector fitting-detection mechanism.
Figure 7:
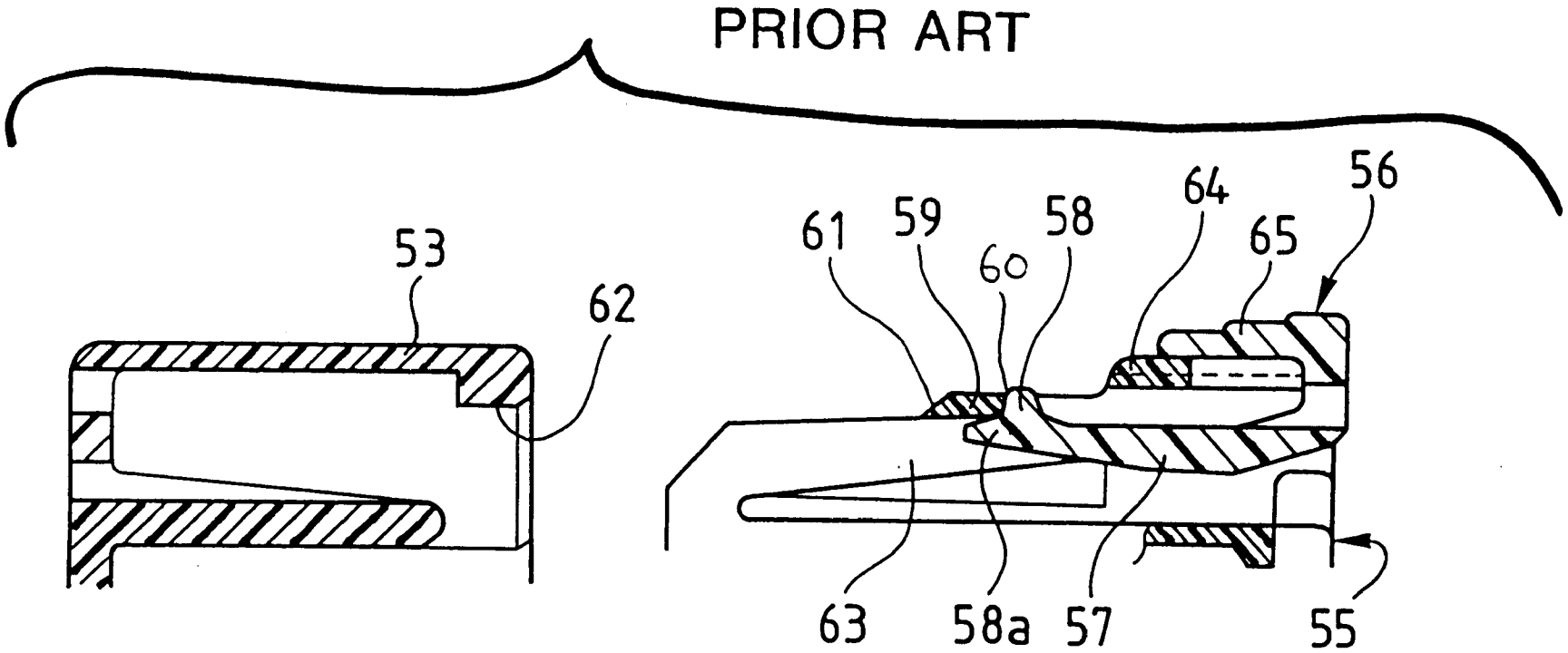
Fig. 7 PRIOR ART
FIG. 7 is a partial longitudinal sectional view showing the main parts of the female and male connectors in a state in which the female and male connectors of FIG. 6 are not fitted.
Figure 8:
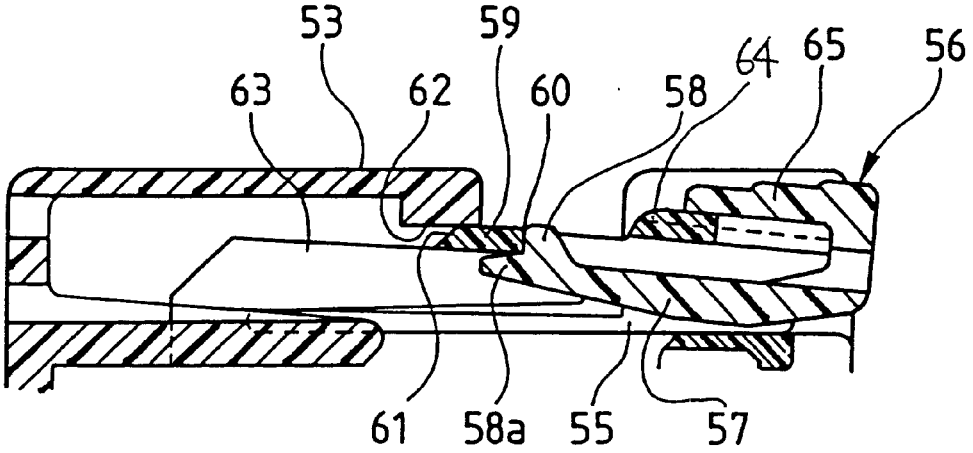
Fig. 8 PRIOR ART
FIG. 8 is an operation explanatory diagram showing a state in which the fitting between the female and male connectors of FIG. 7 is started.
Figure 9:
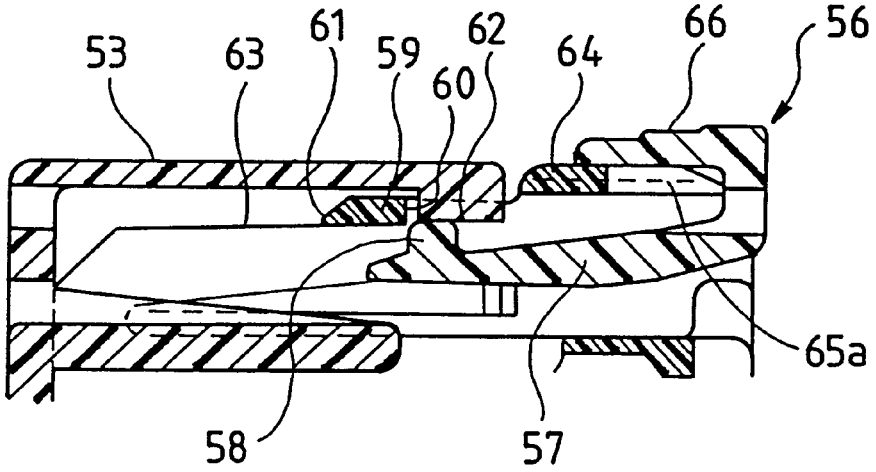
Fig. 9 PRIOR ART
FIG. 9 is an operation explanatory diagram showing the female and male connectors in a midway state of the fitting between the female and male connectors of FIG. 7.
Figure 10:
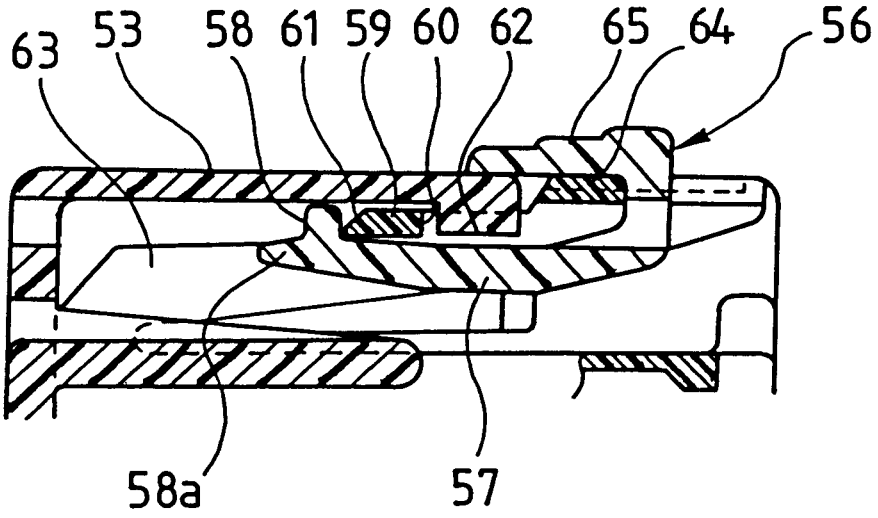
Fig. 10 PRIOR ART
FIG. 10 is a longitudinal sectional view showing a state in which the fitting between the female and male connectors of FIG. 7 is completed.

As shown in FIG. 3, when the fitting of the female and male connectors 2, 4 is started, the front ends of the housings 3, 5 of the female and male connectors 2, 4 abut to each other, so that the female and male terminals 16, 17 are connected to each other. Further, since the projections 12 flex outwardly the flexible detection arms 7 to thereby move the engagement projections 8 outwardly, the engagement projections 8 are disengaged from the provisional engagement holes 10. Then, since the engagement projections 8 move forward beyond the engagement stop plates 9 as shown in FIG. 4, the engagement projections 8 fit into the primary engagement holes 11 to be primarily engaged with the plates 9 as shown in FIG. 5.

In the connector fitting-detection mechanism 1 according to the present invention, a pair of the flexible detection arms 7 are respectively located at the opposite side walls of the fitting detection member 6, and the provisional engagement holes 10, primary engagement holes 11, disengagement projections 12 are located at the housings 3, 5 sides of the female and male connectors 2, 4, and further, the shell body 13 of the fitting detection member 6 is supported by the rear portion of the female connector 2 so as to be slidable to the axial direction of the female connector 2.

Accordingly, the housing structures of the fitting detection member 6 and the female connector 2 can be simplified and the rigidity of the housing structures can be enhanced. Further, the fitting detection member 6 has a pair of the flexible detection arms 7, and therefore, the fitting state of the female and male connectors 2, 4 can be detected through the fitting detection member 6, and also the fitting detection member 6 can have the fitting locking function. As a result, since it is not required to provide another locking mechanism in addition to the fact in that the arrangement of the fitting detection mechanism is simple, the productivity of the connector fitting detection mechanism can be improved and the manufacturing cost thereof can be reduced.

Further, the locking hole 14 is formed in the upper surface of the housing 3 of the female connector 2 which is not interfered by the provisional engagement holes 10 and the primary engagement holes 11. Furthermore, the locking projection 15 is disposed on the upper surface of the housing 5 of the male connector 4 at the portion corresponding to the locking hole 14. Accordingly, since another locking mechanism is thus added, the reliability of the locking function of the connector fitting can be further improved.

The present invention is not limited to the aforesaid embodiment and may be applied to another embodiment which is formed by modifying the aforesaid embodiment suitably. For example, in the aforesaid embodiment, a pair of the provisional engagement holes 10, primary engagement holes 11 and disengagement projections 12 are provided at the both side surfaces of the housings 3, 5 of the female and male connectors 2, 4, and further the locking hole 14 and the locking projection 15 are provided at the upper surfaces of the housings 3 and 5, respectively. However, a pair of the provisional engagement holes 10, primary engagement holes 11 and projections 12 may be provided at the upper and lower surfaces of the housings 3, 5 of the female and male connectors 2, 4, and further the locking hole 14 and the locking projection 15 may be provided at one side surfaces of the housings 3 and 5, respectively. Further, although each of the housings 3, 5 of the female and male connectors 2, 4 and the shell body 13 has a rectangular cylindrical shape, each of them may be formed to have a circular cylindrical shape. Furthermore, although the male terminal 16 is inserted into the female connector 2 and the female terminal 17 is inserted into the male connector 4, the aforesaid embodiment may be modified in a manner that female and male terminals are inserted into the female and male connectors, respectively. Moreover, although the female and male connectors 2, 4 have been constructed as in the aforesaid embodiment, the female and male connectors 2, 4 may be constructed vice versa.

As described above, according to the connector fitting-detection mechanism of the present invention, a pair of the flexible detection arms are respectively provided at the opposite side walls of the engagement detection member; a set of the provisional engagement portion, the primary engagement portion and the disengagement projection are provided on the housing sides of the female and male connectors in correspondence with each of the flexible detection arms; and the shell body of the fitting detection member is supported by a rear portion of the one of the female and male connectors so as to be slidable to an axial direction of the one of the female and male connectors.

Accordingly, the structures of the fitting detection member and the one of the connectors can be simplified and the rigidity thereof can be enhanced. Further, since a pair of the flexible detection arms are provided, the fitting detection member can detect the fitting state of the female and male connectors and have the fitting locking function. Thus, since it is not required to provide another locking mechanism in addition to the fact that the fitting detection mechanism is simple in the arrangement and can be easily manufactured, the productivity of the connector fitting detection mechanism can be improved and the manufacturing cost thereof can be reduced.

Further, the locking hole is provided at the surface of the one of the female and male connectors which is not interfered by the provisional engagement portions and the primary engagement portions, and the locking projection is provided at the other of the female and male connectors in correspondence with the locking hole. Accordingly, since another locking mechanism is thus added, the reliability of the locking function of the connector fitting can be further improved.

What is claimed is:

1. A connector fitting-detection mechanism, comprising:

a pair of provisional engagement portions and a pair of primary engagement portions arranged at one of female and male connectors;

a pair of disengagement projections disposed on a front portion of the other one of the female and male connectors; and a fitting detection member attached onto a rear portion of the one of the female and male connectors, the fitting detection member including:

a frame-like shell body supported by and slidable on the rear portion of the one of the female and male connectors in such a manner that said frame-like shell body substantially circumscribes said rear portion, and a pair of flexible detection arms respectively extending from opposite side walls of the shell body in a connector fitting direction of the one of the female and male connectors, the flexible detection arms having engagement projections, wherein when the fitting detection member is provisionally engaged with the one of the female and male connectors, the engagement projections are engaged with the provisional engagement portions, respectively; and wherein when the female and male connectors are completely fitted to each other, the engagement projections are primarily engaged with the primary engagement portions, respectively.

2. The connector fitting-detection mechanism of claim 1, wherein, when fitting of the female and male connectors is started, the disengagement projections respectively abut against the engagement projections, and afterwards, the fitting detection member is pushed to move the engagement projections beyond the provisional engagement portions to release the provisional engagement.

3. The connector fitting-detection mechanism of claim 1, further comprising:

a locking hole formed in a surface of the one of the female and male connectors which is not interfered by the provisional engagement portions and the primary engagement portions; and a locking projection formed on the other one of the female and male connectors in correspondence with the locking hole.

* * * * *